US005503568A

United States Patent [19]

Pryce

[11] Patent Number: 5,503,568

[45] Date of Patent: Apr. 2, 1996

[54] ELECTRICAL CONNECTOR FOR TWIN CORE ELASTOMERIC CONDUCTIVE STRIP

[75] Inventor: John E. Pryce, Hertford Heath, Great Britain

[73] Assignee: The Whitaker Corporation, Wilmington, Del.

[21] Appl. No.: 304,750

[22] Filed: Sep. 12, 1994

[30] Foreign Application Priority Data

| | | | |
|---|---|---|---|
| Sep. 22, 1993 | [GB] | United Kingdom | 9319589 |
| Feb. 22, 1994 | [GB] | United Kingdom | 9403361 |

[51] Int. Cl.[6] ..... H01R 4/24

[52] U.S. Cl. ..... 439/427; 439/596; 439/465

[58] Field of Search ..... 439/578, 583–585, 439/675, 692, 695, 596, 598–599, 460, 470, 465

[56] References Cited

U.S. PATENT DOCUMENTS

| | | | |
|---|---|---|---|
| 3,662,491 | 5/1972 | Boyriven | 49/28 |
| 5,085,594 | 2/1992 | Kaelin | 439/427 |
| 5,192,837 | 3/1993 | Chardon | 200/61.41 |

FOREIGN PATENT DOCUMENTS

| | | | |
|---|---|---|---|
| 0128472 | 6/1983 | European Pat. Off. | 439/692 |
| 0383671 | 8/1990 | European Pat. Off. . | |
| 2029134 | 10/1970 | France . | |
| 2001293 | 7/1971 | Germany . | |
| 8708715 | 11/1987 | Germany . | |
| 3813233 | 12/1988 | Germany . | |
| 3737501 | 5/1989 | Germany . | |
| 2062979 | 5/1981 | United Kingdom | 439/596 |
| 2199197 | 6/1988 | United Kingdom | 439/578 |
| 9310579 | 5/1993 | WIPO | 439/578 |

*Primary Examiner*—David L. Pirlot
*Assistant Examiner*—Jill DeMello
*Attorney, Agent, or Firm*—Eric J. Groen; Adrian J. LaRue

[57] ABSTRACT

An electrical connector comprising an insulative housing, a pair of inmoulded terminals and a separate core support member, makes electrical contact with a twin core flexible conductor comprising a flexible elastomeric outer tube and flexible spaced apart inner conductors. The core support member comprises a core section substantially filling the inner space formed by the conductors and tube thereby providing support to the flexible tube conductor such that pin sections of the terminals can be sandwiched between the conductors and the core section and additionally sandwiching the flexible outer tube between strain relief projections of core support member arms and the core section for securely fixing the connector thereto. The connector is of a cost-effective and simple construction that is also easy to assemble. A certain length of the twin core tube conductor can be positioned along the top sill of an automobile window frame thereby providing a detection means for objects captured between the window and frame, whereby pressure against the flexible tube causes the conductors to enter into electrical contact.

25 Claims, 9 Drawing Sheets

ELECTRICAL CONNECTOR FOR TWIN CORE ELASTOMERIC CONDUCTIVE STRIP

BACKGROUND OF THE INVENTION

1. Field of the Invention

This invention relates to an electrical connector for making electrical connection to spaced conductive cores disposed within a flexible tube.

2. Description of the Prior Art

The implementation of electrical motors to command closure means such as automobile windows is now very wide spread, these electrical devices requiring a safety mechanism to prevent injury to persons caught during closing thereof. Electrically operated windows of an automobile often have no particular safety mechanism, the safety being implicit in that the torque of the electrical motor is sufficiently low to prevent serious injury. The raising of the electrical window at a certain desired speed however, requires a sufficiently powerful motor to overcome the inertial and frictional forces. Under certain circumstances, the force exerted by the closure means upon closing may be dangerously high, in particular for young children or weak persons.

There is therefore a need to provide a means of detecting an obstacle captured within an electrically operated closure means such as an automobile window. One such detection means designed for this very purpose, comprises a flexible hollow tube having a pair of spaced apart flexible conductors extending along the inner wall of the tube. This tube would be placed proximate the upper sill of the automobile window frame, whereby an obstacle captured between the closing window and the window frame, would compress the flexible tube thereby producing contact between the flexible conductors therein. These conductors would be electrically connected to the electrical motor and contact therebetween would cause appropriate command of the motor. In particular, this known tube includes carbon conductors, which are difficult to provide an interconnection thereto as the carbon conductors can neither be adequately crimped or soldered.

In order to electrically interconnect the electrical motor and the twin core conductor tube, an electrical connector means that is safe and reliable must be devised.

SUMMARY OF THE INVENTION

The object of this invention therefore, is to provide a reliable electrical connector for making electrical connection between a flexible twin core conductor tube and electrical conducting wires.

A further object of this invention, is to provide an electrical connector for making connection to conductors mounted in a flexible tube that is easily assembled and cost-effective, yet reliable.

The objects of this invention have been achieved by providing an electrical connector for making electrical connection to a tube conductor comprising spaced conductive cores disposed within an elastomeric tube, the connector comprising an insulative housing and terminals mounted therein, characterized in that the connector also comprises a core support section insertable between the conductive cores, and gripper means disposed over the core support section for holding the tube therebetween.

DETAILED DESCRIPTION OF THE PREFERRED EMBODIMENT

Figure 1:
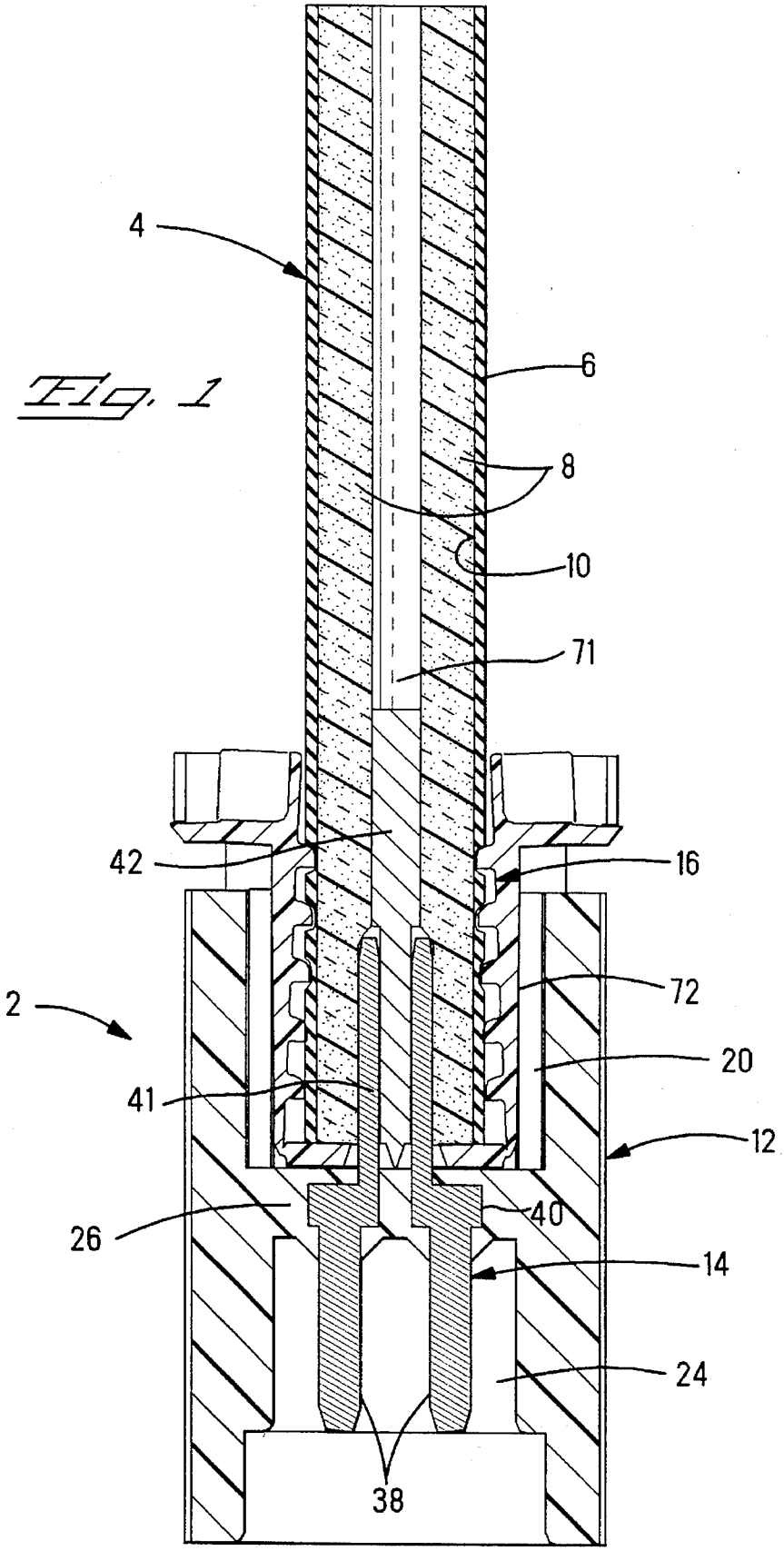
FIG. 1 is a cross-sectional view through the preferred embodiment of this invention.

Referring to FIG. 1, an electrical connector 2 is shown connected to a twin core flexible tube conductor 4 comprising an elastomeric outer tube 6 and a pair of spaced apart opposed flexible core conductors 8 attached to an inner wall 10 of the tube 6. The connector 2 comprises an insulative housing 12, a pair of electrical conducting terminals 14 and a separate core support member 16. Referring now to FIGS. 13 to 17, the connector housing 12 and terminals 14 will be described in more detail. The connector housing 12 comprises a conductor connection section 18 having a conductor receiving cavity 20, and a complementary receiving section 22 having a connection receiving cavity 24, a connector housing shell 25 surrounding the cavities 20, 24, and a partitioning wall 26 separating the cavities 20 and 24. Proximate an end of the conductor connection section 18 are U-shaped retaining members 28 extending outwardly on either side of the connector housing shell 25, the retention members 28 having an inner guide surface 30 and a rearward retention face 32. Also attached to the outside of the connector shell 25, is a mounting member 34 having a resilient projection 36 for securely mounting the connector to a bracket of some structure such as an automobile door panel.

The terminals 14 comprise tab portions 38 extending into the housing cavity 24 from the partitioning wall 26, attached to mid-portions 40 (see FIG. 1) which are inmoulded to the partitioning wall 26, the mid portions 40 extending into core contact pins 41 that project into the cavity section 20. Due to the moulding of the partitioning wall 26 over the contact mid-sections 40, the terminals 14 are securely mounted to the housing 12 and the conductor receiving cavity 20 is perfectly sealed off from the complementary connector receiving cavity 24.

Referring now to FIGS. 8 to 12, the core support member 16 will now be described in more detail. The core support member 16 comprises a central elongated core section 42 having a pair of opposed concave surfaces 44 profiled to receive the flexible core conductors 8 snugly thereagainst, and pin terminal receiving grooves 46 extending from a pin receiving end 48 of the core section 42 to an approximately middle section thereof, the grooves 46 being cut into the concave surfaces 44. Extending radially outwards from the pin receiving end 48, is a flange 50 having pin receiving cavities 52 therethrough providing access to the grooves 46. Gripper means 54 in the form of long arms 55 disposed symmetrically about the flange 50 are attached integrally thereto via thin flexible hinges 56, the arms 54 having a plurality of juxtaposed strain relief projections 58 jutting out of an inner surface 64 thereof. Extending from the arms 54 are latching means 66 cooperable with the connector housing retention flanges 28 for retaining the connector housing thereto. The latching means 66 comprise a latching projection 68 and a tool receiving release member 70.

Figures 2, 3:
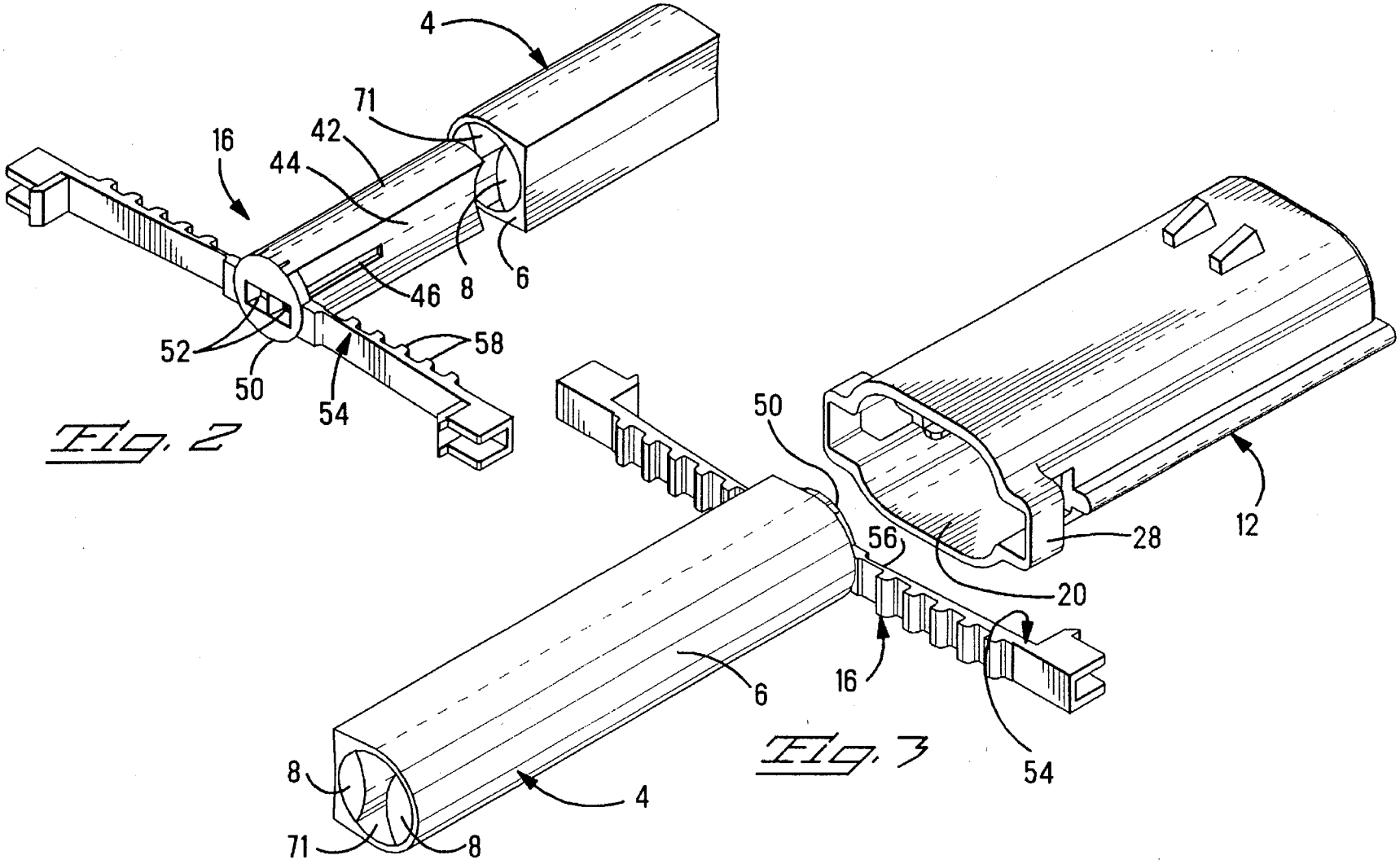
FIG. 2 is an isometric view of a core support member about to be inserted into a twin core conductor tube.
FIG. 3 is an isometric view of the assembled core support and tube of FIG. 2 about to be mounted in a connector housing.
Figures 4, 5:
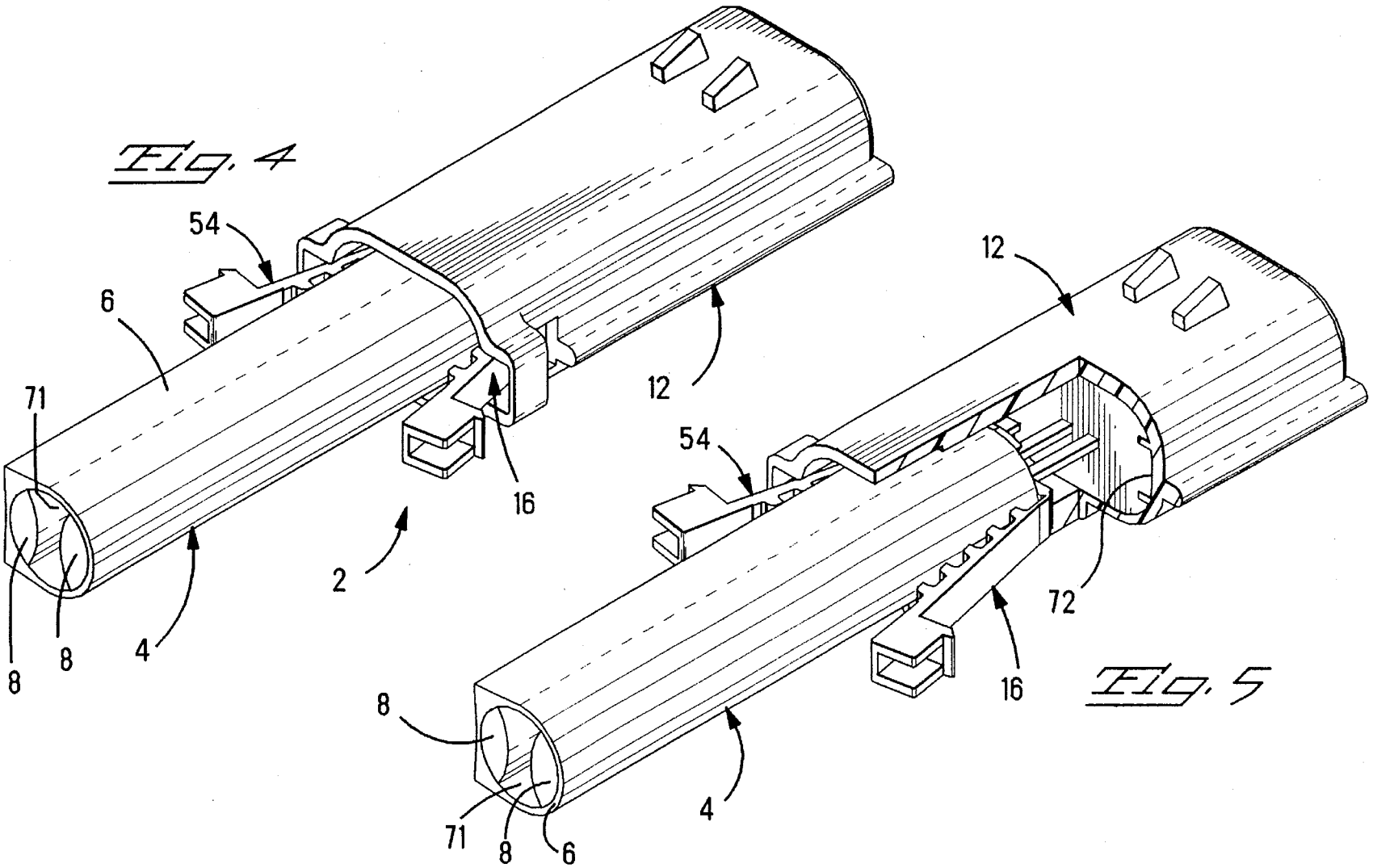
FIG. 4 is an isometric view of the connector elements of FIG. 3 almost fully assembled.
FIG. 5 is the same as FIG. 4 except that part of the connector housing is cut away for better illustration.

Referring now to FIGS. 2 to 7, assembly of the connector and conductor 4 will now be described. Referring to FIG. 2, the core member 16 is first mounted to the conductor 4 by inserting the core section 42 into a cavity area 71 defined by the inner contour of the flexible tube 6 and the conductors 8, whereby the core section 42 is profiled to substantially fill this cavity area 71. Insertion of the core member 16 is effectuated until the flange portion 50 thereof abuts the end of the conducting tube 4 as shown in FIG. 3. The assembled conductor tube 4 and core support member 16 can then be aligned to the conductor receiving cavity 20 of the connector housing 12 and then approached together until the core member retention arms 54 abut the housing flange members 28. Continued urging of the conductor tube 4 towards the housing cavity 20, causes the gripper arms 54 to pivot about the flexible hinges 56 thereby biasing the arms 54 against the flexible tube 6 and allowing the conductor 4 to enter the cavity 20 as shown in FIGS. 4 and 5.

Simultaneously to the latter, the pin contacts 41 are inserted through the flange holes 52 and along the grooves 46 of the core support member 16. The pin contacts 41 are of greater thickness than the height of the groove 46 thus projecting outwards of the concave surfaces 44 against which the resilient conductors 8 are biased (see FIG. 1). The conductors 8 are constituted of a conducting material such as carbon integrated within a flexible elastomeric matrix which results in a very flexible conductor that is resiliently compressed about the projecting portion of the pin contacts 41 that are disposed between the core section 42 and conductors 8. Resilient urging of the conductors 8 against the pin contacts 41 ensures good electrical contact therebetween. Further insertion then causes the retaining projection 68 of the latching means 66 to abut the housing retention members 28, a forward facing chamfer 69 of the latching projection 68 enabling it to bias beneath the retention member inner surface 30 whereby the resilient force emanates from compression of the gripper arms 54 against the tube conductor 4 via the strain relief projections 58 that dig into the tube 6. Insertion is continued until the latching projection 68 is past the retaining face 32 of the member 28 such that the projection 68 engages therebehind thereby retaining the connector housing 12 to the core support member 16.

Opposed inner side wall sections 72 adjacent the core member gripper means 54, ensure that the arms 54 are biased against the tube 6 such that the strain relief projections dig thereinto thereby securely retaining the connector 2 to the tube conductor 4 against a tensile force therealong. The core member section 42 not only prevents collapsing of the tube 4 in response to the biasing together of the gripper arms 54, but also provides a supporting means enabling compression of the conductors 8 against the pin contact 41 for good electrical connection therebetween. In order to release the connector 2 from the tube conductor 4, an adequate tool can be placed within the tool receiving release member 70, followed by squeezing the arms 54 together until the latching projections 58 are biased below the connector flange inner surface 30 thereby enabling retraction of the connector housing 12 therefrom.

Figures 6, 7:
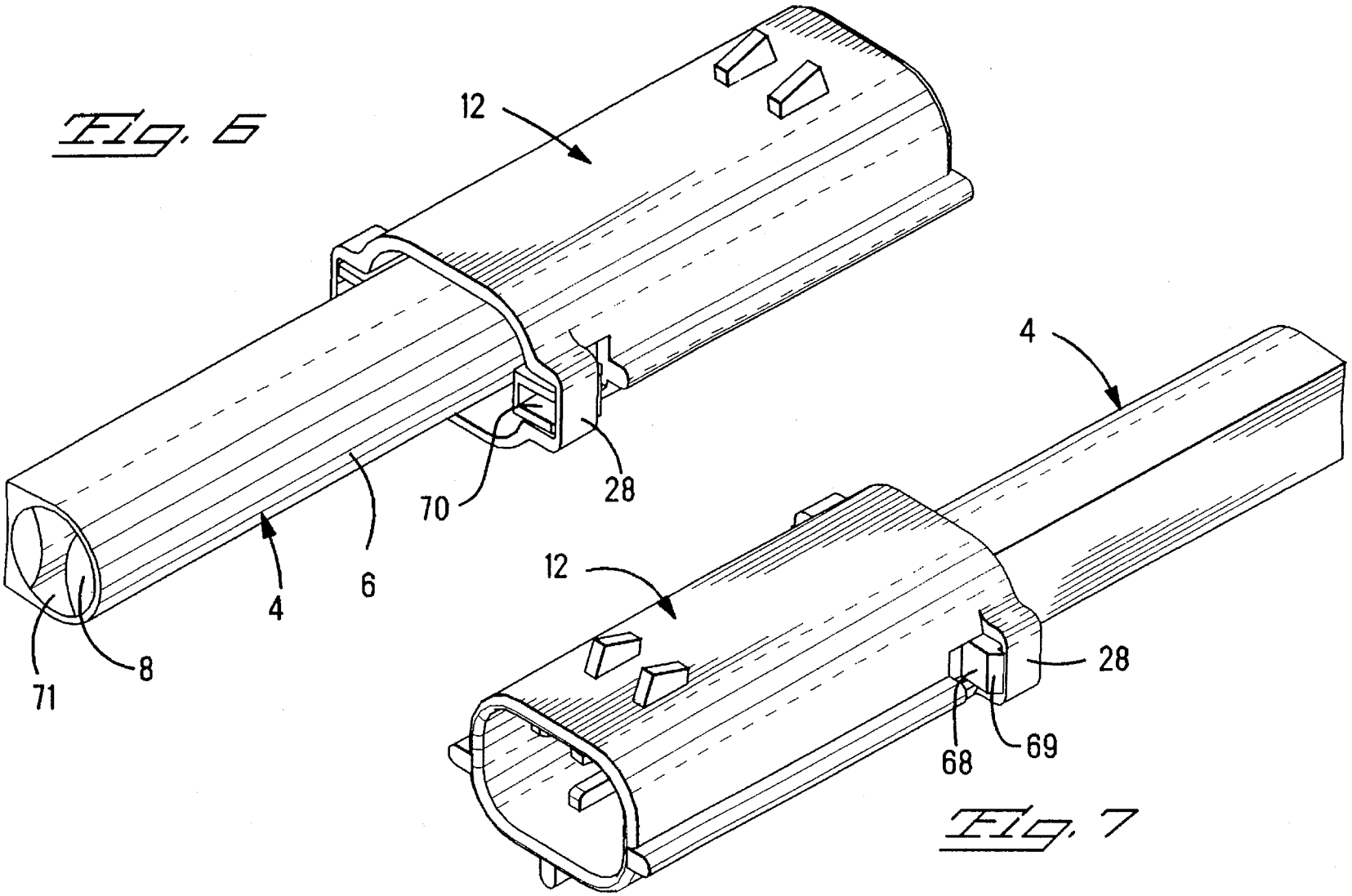
FIGS. 6 and 7 are isometric views shown from opposing directions, of the assembled connector and twin core conductor tube.
Figures 8, 9:
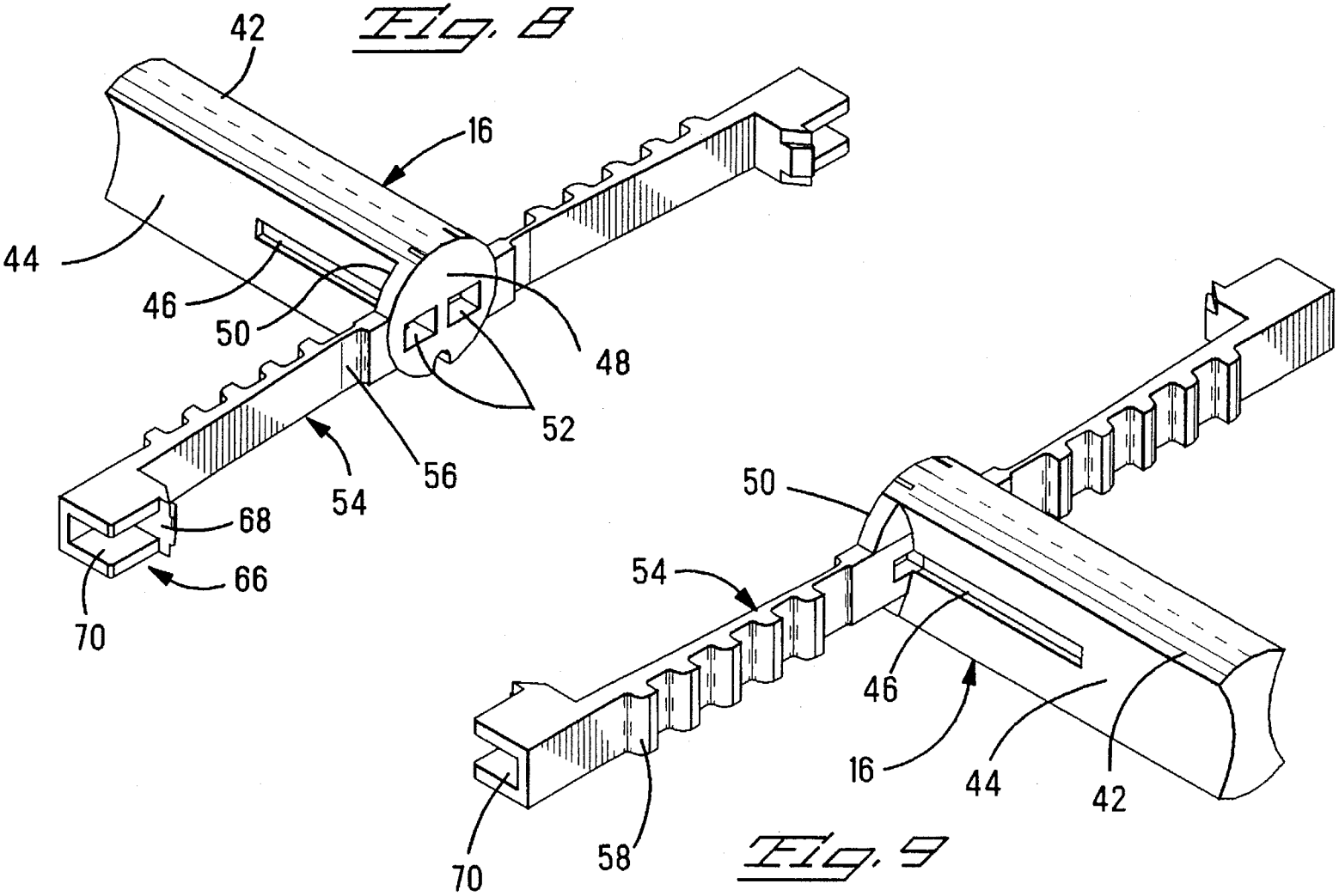
FIGS. 8 and 9 are isometric views of the core support member.
Figure 10:
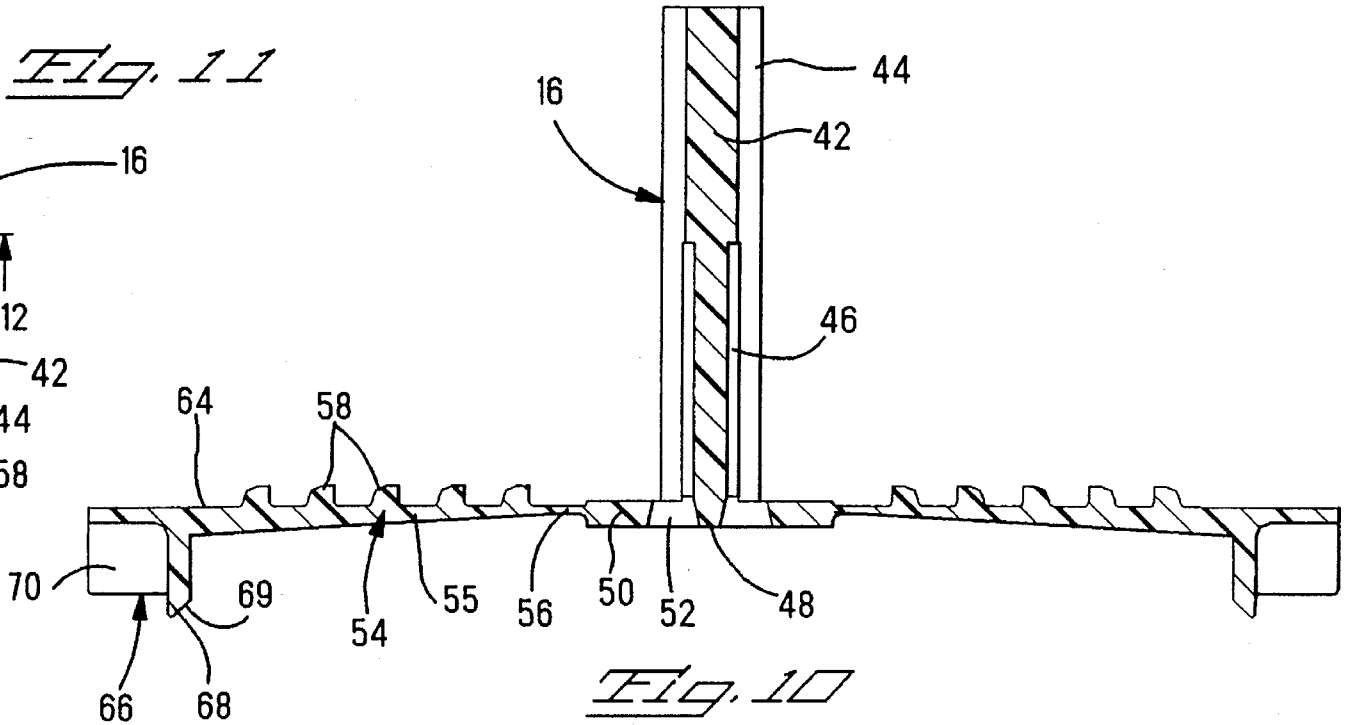
FIG. 10 is a cross-sectional view through lines 10—10 of the core support member of FIG. 11.
Figure 11:
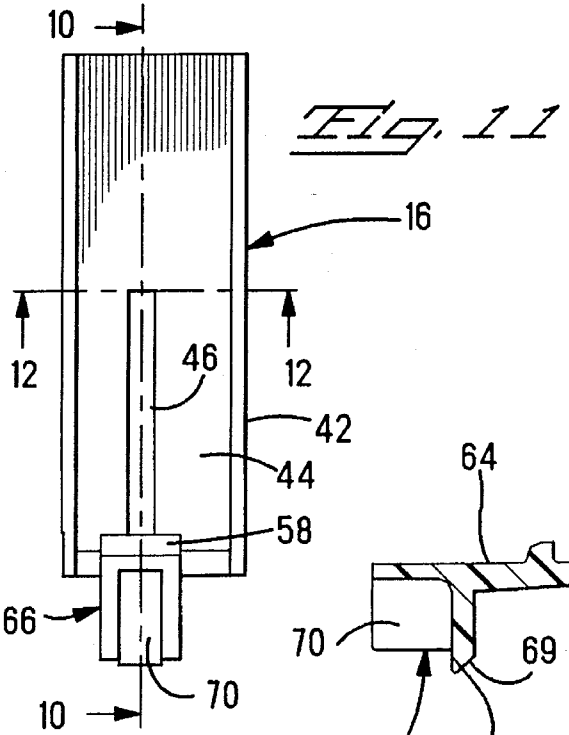
FIG. 11 is a side view of the core support member.
Figure 12:
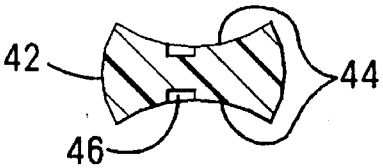
FIG. 12 is a cross-sectional view through lines 12—12 of FIG. 11.
Figures 13, 14:
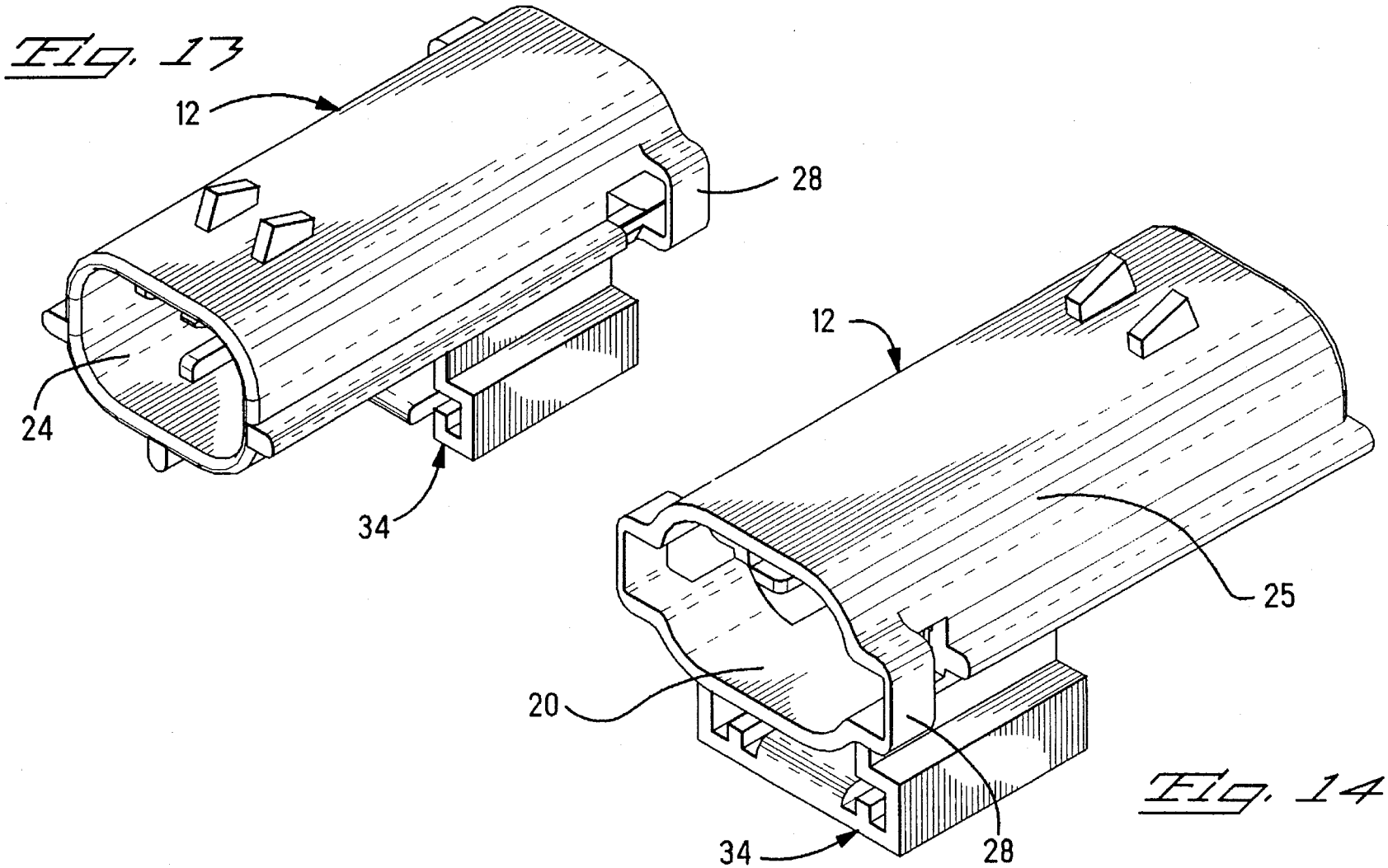
FIGS. 13 and 14 are isometric views of the connector housing.
Figure 15:
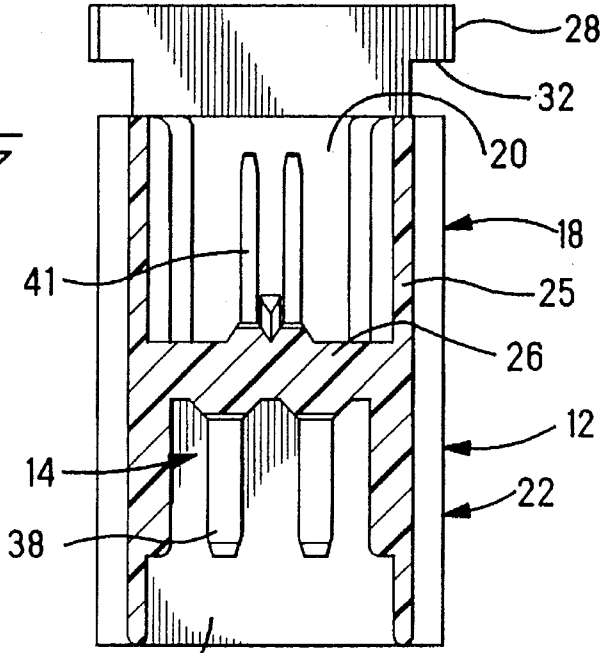
FIG. 15 is a cross-sectional view through lines 15—15 of FIG. 16.
Figure 16:
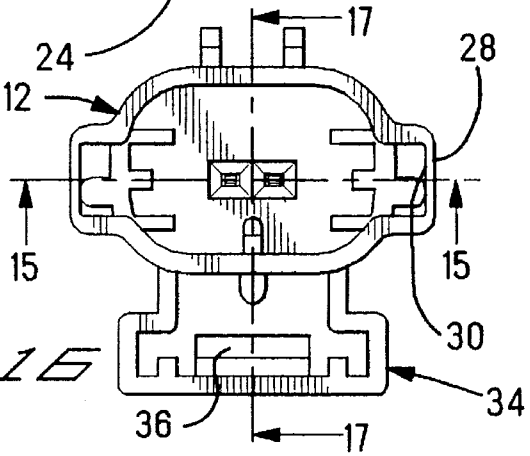
FIG. 16 is a front view of the connector housing.

The assembled electrical connector and tube conductor as shown in FIGS. 6 and 7, can be coupled to a complementary connector that is electrically connected to electrical circuitry commanding the motor of an automobile window for example. A certain portion of the tube conductor 4 can be placed proximate the sill of the window frame such that an object captured between the rising window and the window frame will squeeze the flexible tube 6 until the conductors 8 enter into electrical contact with each other, thereby affecting the electrical motor command circuitry which can be appropriately designed for safe operation thereof.

Figure 17:
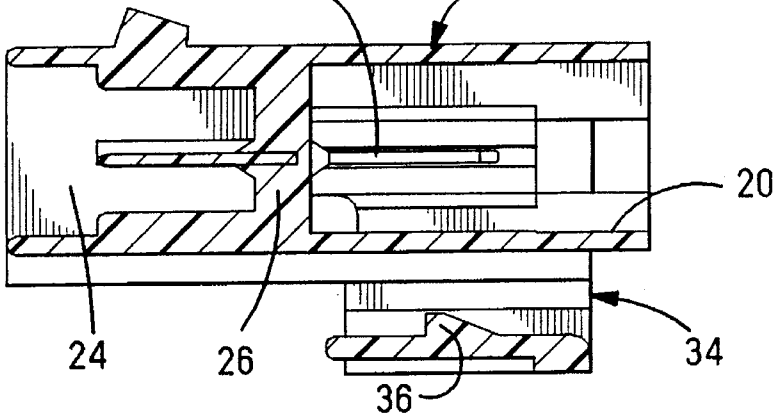
FIG. 17 is a cross-sectional view through lines 17—17 of FIG. 16.

The connector housing 12 can be provided with mounting means 34 as shown in FIG. 17 for securely latching the connector 2 to the body work of a vehicle for example.

Figure 18:
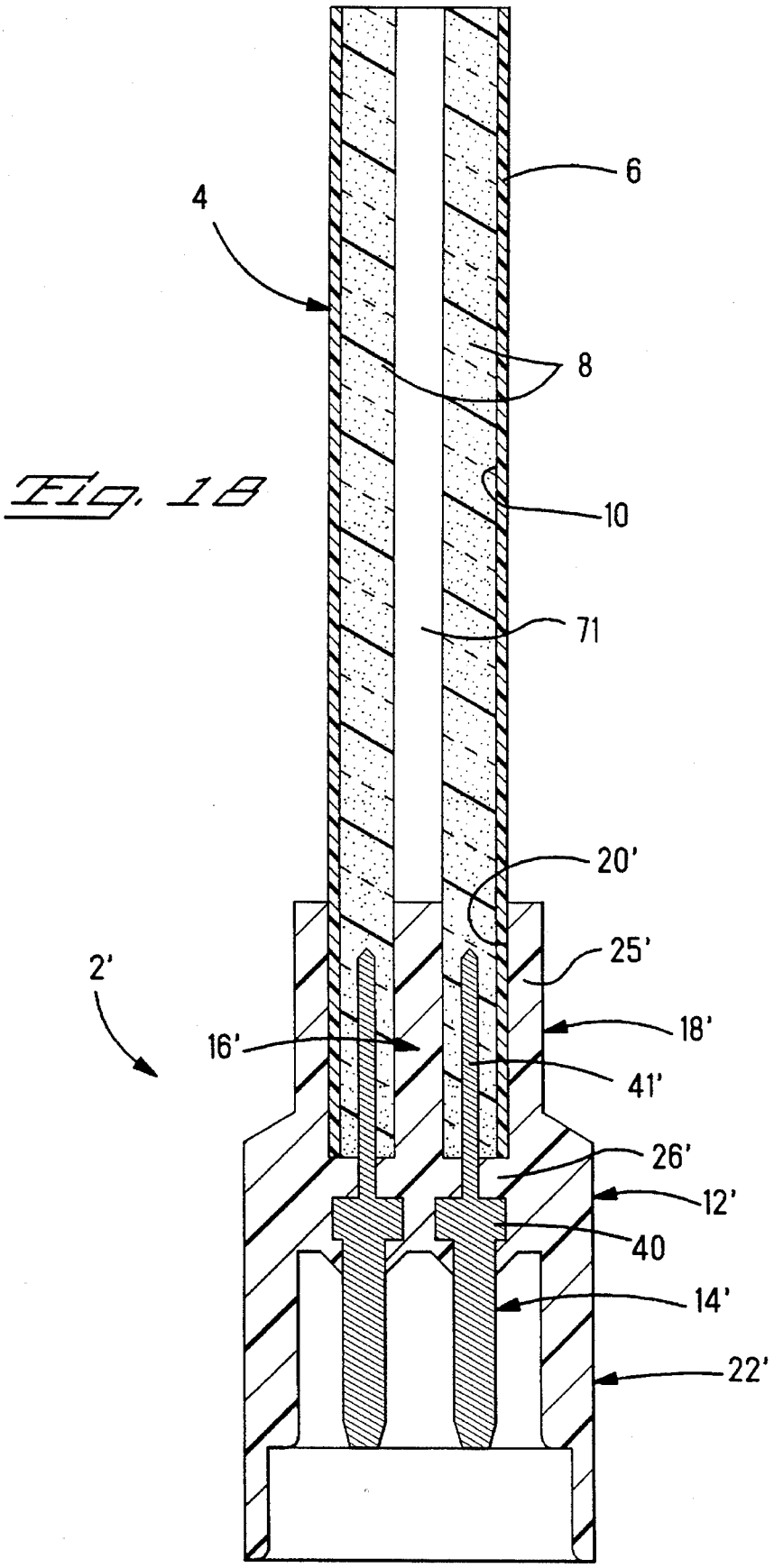
FIG. 18 is a cross-sectional view of an alternate embodiment of this invention.

Referring now to FIG. 18, another connector embodiment 2' is shown comprising an insulative housing 12', overmoulded to a pair of electrical conducting terminals 14' and further comprising an integral core support member 16'. The connector 2' has a complementary receiving section 22' similar to the receiving section 22 of the connector 2 and will therefore not be described further. The connector housing 12' comprises a conductor connection section 18' having a conductor receiving cavity 20' surrounded by an outer housing shroud 25' for receiving the tube conductor 4 therein. The core conductors 8 are received between the core support member 16', that extends into the cavity 20' and the outer shroud 25'.

The terminals 14' comprise core contact pins 41' extending from a partitioning wall 26' of the housing that is overmoulded to the terminals 14'. The other end of the terminals 14' is similar to that of the terminals 14 shown in the embodiment of FIGS. 1–17, and will therefore not be described any further. The core contact pins 41' are positioned intermediate the outer shroud 25' and the core support member 16' and comprise pointed tips for piercing into the conductive cores 8 of the conductor 4.

Assembly of the conductor 4 to the connector 2' is effectuated by simply inserting the conductor 4 into the cavity 20' such that the conductive cores 8 are seated snugly between the core support member 16' and outer shroud 25'. Insertion is continued until the conductor 4 abuts the partitioning wall 26', the contact pins 41' having pierced into the conductive cores 8 for electrical contact therewith. The connector 2' can be securely fixed to the conductor 4 by providing a bonding agent between the shroud 25 and the conductor outer tube 6. The bonding agent could also provide a sealing means between the conductor 4 and the conductor connection section 18' for preventing corrosion of the contact pins 41' by preventing ingress of liquids or moist air that could create condensation water inside the conductor 4. One could also imagine sealing and bonding of the connection section 18' to the conductor 4 by, for example, overmoulding an elastomer over the end of the connection section 18' and a portion of the conductor 4. Sealing of both embodiments 2, 2' can of course be effectuated in other ways known in the electrical connector art, for example positioning an elastomeric seal or a sealing gel between the conductor and connector.

Advantageously therefore, the present invention provides a reliable connector for making electrical connection between a flexible twin core tube conductor and electrical circuitry, the connector being rapidly and easily assembled yet comprising very secure retention means: in a first embodiment by the bias of the gripper arms and strain relief projections that clasp the conductors and tube against an inner core member; and in a second embodiment by bonding a connector shroud to the conductor whilst simultaneously providing sealing therebetween. Clasping of the connector retention arms against the tube conductor compresses the flexible core conductors against terminals of the connector for good electrical connection therebetween.

The invention claimed is:

1. An electrical connector for making electrical connection to a tube conductor comprising spaced conductive cores disposed within an elastomeric tube, the connector comprising an insulative housing and terminals, the connector also comprising a core support section insertable between the conductive cores, characterized in that gripper means are disposed over the core support section for holding the tube between the core support section and the gripper means, the gripper means being attached to the core support via flexible hinges, the connector housing being mountable over the gripper means, and securely lockable thereto.

2. The connector of claim 1 characterized in that the gripper means and core support section are integral.

3. The connector of claim 1 characterized in that the core support section is profiled to substantially fill a cavity area defined by an empty space between the conductive cores within the elastomeric tube.

4. The connector of claim 1 characterized in that the terminals are in-moulded to the insulative housing.

5. The connector of claim 1 characterized in that the gripper means are attached to the core support section via flexible hinges.

6. The connector of claim 1 characterized in that the insulative housing comprises an outer shell extending around and along core contact pins of the terminals, the outer shell profiled to receive the gripper means, tube conductor and core support section therein, the outer shell profiled such that the gripper means is resiliently compressed against the tube.

7. The connector of claim 1 characterized in that the gripper means and core support section are disposed such that the conductive cores are compressed therebetween when assembled.

8. The connector of claim 1 characterized in that the core support section comprises a terminal receiving end wall proximate an end of the tube when assembled thereto, the end wall having cavities therethrough for receiving and guiding the terminals between the core support section and the conductive cores.

9. The connector of claim 1 characterized in that the terminals have pin contact sections having pointed tips for piercing into the conductive cores for electrical contact therewith.

10. The connector of claim 1 characterized in that the terminals have a core contact section comprising pin contacts insertable between the core support section and the conductive cores.

11. The connector of claim 10 characterized in that the core support section has longitudinal grooves for receiving the pin contacts.

12. The connector of claim 1 characterized in that the gripper means comprises latching means cooperable with housing latching means for securing the housing thereto.

13. The connector of claim 12 characterized in that the gripper latching means comprises a tapered projection proximate an end of the gripper means, and the housing latching means comprises a bracket at a rear end thereof, the bracket slidable over the tapered projection thereby resiliently biasing the gripper means inwards against a resilient compression of the tube conductor until latching of the tapered projection behind a shoulder of the bracket.

14. The connector of claim 1 characterized in that the gripper means comprises at least one arm extendable longitudinally along the tube, the arm having projections along an inner surface, the projections extending transverse to a longitudinal direction for digging into the tube and retaining the gripper means thereto in opposition to a longitudinal pulling force.

15. The connector of claim 14 characterized in that the gripper means comprises two gripper arms disposed substantially symmetrically about the core support section.

16. The connector of claim 1 characterized in that the gripper means comprises an outer shroud defining a cavity for receiving the tube conductor snugly therein.

17. The connector of claim 16 characterized in that the tube conductor is bonded to the outer shroud for retention thereto, the bonding also providing sealing therebetween.

18. An electrical connector for making electrical connection to a tube conductor comprising spaced conductive cores disposed within an elastomeric tube, the connector comprising an insulative housing and terminals, the connector also comprising a core support section insertable between the conductive cores, characterized in that gripper means are disposed over the core support section for holding the tube therebetween, the gripper means comprising an outer shroud defining a cavity for receiving the tube conductor snugly therein, the terminals comprising pin contact sections spaced from the core support and having pointed tips for piercing into the conductive cores for electrical contact therewith.

19. The connector of claim 18 characterized in that the gripper means and core support are integral.

20. The connector of claim 18 characterized in that the core support is profiled to substantially fill a cavity area defined by an empty space between the conductive cores within the elastomeric tube.

21. The connector of claim 18 characterized in that the terminals are in-moulded to the connector housing.

22. An electrical connector for making electrical connection to a tube conductor comprising spaced conductive cores disposed within an elastomeric tube, the connector comprising an insulative housing and terminals, the connector also comprising a core support section insertable between the conductive cores, characterized in that the insulative housing comprises an outer shell extending around and along core contact pins of the terminals, the outer shell profiled to receive the gripper means, tube conductor and core support section therein, the outer shell profiled such that the gripper means is resiliently compressed against the tube.

23. An electrical connector for electrical connection to a conductor including spaced conductive members disposed within a flexible tube, comprising an insulative housing having a conductor support section insertable between the spaced conductive members and gripper means extending along said conductor support section for holding the flexible tube therebetween; and electrical terminals secured in said insulative housing having contact pins for respective electrical connection with the spaced conductive members.

24. An electrical connector as claimed in claim 23, wherein the contact pins are disposed between said conductor support section and the spaced conductive members.

25. An electrical connector as claimed in claim 23, wherein the contact pins have pointed tips for piercing into the spaced conductive members.

* * * * *